US010532918B2

(12) United States Patent
Hannan et al.

(10) Patent No.: US 10,532,918 B2
(45) Date of Patent: Jan. 14, 2020

(54) PULLEY DEVICE

(71) Applicants: Scott Hannan, Haverhill, MA (US); Janice Hannan, Haverhill, MA (US); Geoffrey Hannan, Haverhill, MA (US); Timothy Hannan, Salem, NH (US); Joshua Hannan, Methuen, MA (US); John-Benjamin Hannan, Plaistow, NH (US)

(72) Inventors: Scott Hannan, Haverhill, MA (US); Janice Hannan, Haverhill, MA (US); Geoffrey Hannan, Haverhill, MA (US); Timothy Hannan, Salem, NH (US); Joshua Hannan, Methuen, MA (US); John-Benjamin Hannan, Plaistow, NH (US)

( * ) Notice: Subject to any disclaimer, the term of this patent is extended or adjusted under 35 U.S.C. 154(b) by 154 days.

(21) Appl. No.: 15/863,942

(22) Filed: Jan. 7, 2018

(65) Prior Publication Data

US 2019/0210847 A1 Jul. 11, 2019

(51) Int. Cl.
*B66D 3/04* (2006.01)
*B66D 3/06* (2006.01)

(52) U.S. Cl.
CPC . *B66D 3/04* (2013.01); *B66D 3/06* (2013.01)

(58) Field of Classification Search
CPC ..... B66D 3/04; B66D 3/06; A01K 27/003
See application file for complete search history.

(56) References Cited

U.S. PATENT DOCUMENTS

| | | | | | |
|---|---|---|---|---|---|
| 5,632,234 | A * | 5/1997 | Parker | A01K 27/003 | 119/795 |
| 5,701,848 | A * | 12/1997 | Tozawa | A01K 27/003 | 119/795 |
| 5,724,921 | A * | 3/1998 | Bell | A01K 27/00 | 119/795 |
| 7,926,451 | B2 * | 4/2011 | Foster | A01K 27/003 | 119/787 |
| 2006/0201449 | A1 * | 9/2006 | DiDonato | A01K 27/004 | 119/795 |
| 2007/0181863 | A1 * | 8/2007 | Plzak | B66C 1/14 | 254/338 |
| 2015/0090196 | A1 * | 4/2015 | Fleming | A01K 27/003 | 119/795 |

* cited by examiner

*Primary Examiner* — Michael E Gallion
(74) *Attorney, Agent, or Firm* — Andover Patents, LLC; Daniel N. Beinart

(57) ABSTRACT

A pulley device includes a strap loop, a cord-securing component and cord respectively attached to the strap loop, a pulley component, the cord attached to the pulley component. The pulley component includes a housing, and may include a wheel that rotates within the housing. The wheel may have a circumferential groove or flat circumferential side to accommodate a cord or belt. The cord may form a loop, enabling the cord loop to be secured on the cord-securing component so that the pulley device may be worn on a person's wrist.

10 Claims, 9 Drawing Sheets

PULLEY DEVICE

TECHNICAL FIELD

The subject matter described herein relates generally to the field of pulling and lifting equipment, and more particularly to a pulley device, i.e., a device for pulling and lifting that incorporates one or more pulleys.

BACKGROUND

Existing pulling and lifting equipment for an outdoors enthusiast, hunter or other person with pulling and lifting needs are typically non-configurable, unavailable due to lack of portability, and/or cumbersome to use. Furthermore, they are typically not easy to use, store, carry, and deploy, and are not readily available when needed. Some existing pulley devices require motorized power, which in some locations is disallowed or inaccessible.

Therefore, a need exists for non-motorized pulling and lifting equipment that provides a more configurable, portable, and less cumbersome solution. Furthermore, a need exists for pulling and lifting equipment that is easy to use, store, carry, and deploy, and that is readily available when needed.

A pulley device constructed as described herein addresses these deficiencies.

SUMMARY

In one aspect, a pulley device includes a strap loop, a first cord attached to the strap loop, a pulley component attached to the first cord, and a cord-securing component attached to the strap loop. The strap loop comprises a flexible material. The cord-securing component is capable of securing the first cord, enabling the pulley device to be worn on a person's wrist.

In some implementations, the following features can be present in any suitable combination.

The first cord can comprise a flexible material.

The strap loop can be substantially flat.

The first cord can comprise a loop capable of being secured over the cord-securing component. The cord-securing component can be a buckle. A position of the cord-securing component on the strap loop is capable of being adjusted.

The pulley component can include a housing. The pulley component can include a wheel arranged to rotate within the housing, and the wheel can include a circumferential groove to accommodate a second cord, or the wheel can include a substantially flat circumferential side to accommodate a belt. The pulley component can include a groove to accommodate a second cord.

In another aspect, a pulley device includes a strap, a buckle including one or more buckle components, a first cord attached to the strap, and a pulley component attached to the first cord. One of the buckle components is attached to a first end of the strap.

In some implementations, the following features can be present in any suitable combination.

The strap can be substantially flat.

A second end of the strap can be joined to the first end of the strap to form a strap loop.

The pulley device can include a cord-securing component attached to the strap loop.

DETAILED DESCRIPTION

Figure 1A:
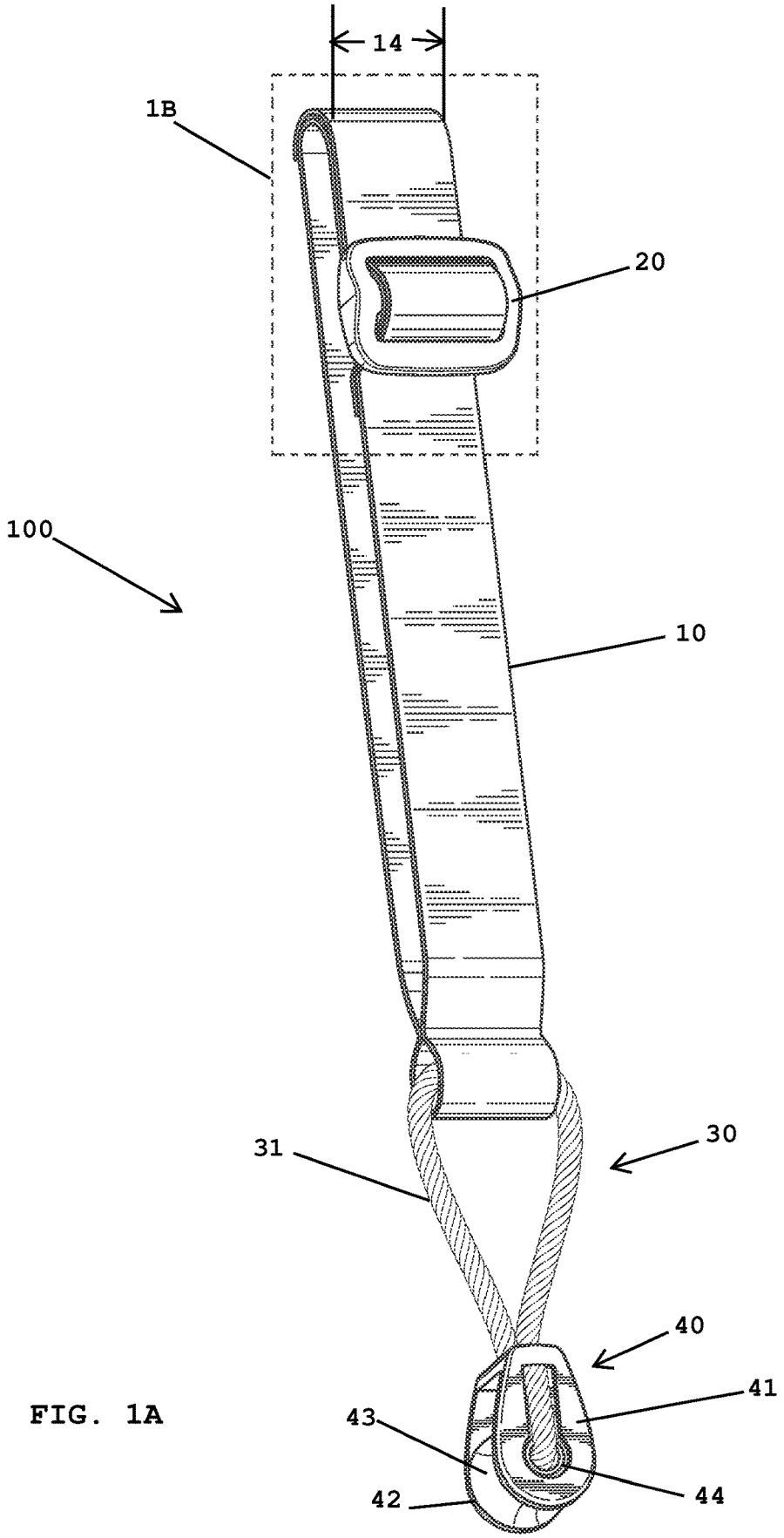
FIG. 1A depicts a perspective view of an embodiment of a pulley device.

An embodiment of a pulley device 100 and its components, as depicted in FIGS. 1A-7, comprises a strap loop 10, a buckle 20 attached to said strap loop 10, a cord 30 attached to the strap loop 10, and a pulley component 40 to which the cord 30 is attached. The pulley component 40 comprises a housing 41 and a wheel 42 that rotates within housing 41. In the depicted embodiment, wheel 42 comprises a circumferential groove 43 to accommodate a cord 200, where a first end 201 of the cord 200 is typically either attached to an object 300 to be pulled or lifted or anchored to a fixed object and a second end 202 of the cord 200 may be pulled by a person 400.

In other embodiments, a wheel 42 does not comprise a circumferential groove 43, but instead comprises a substantially flat circumferential side (not shown) to accommodate a substantially flat belt (not shown) instead of a cord 200.

In yet other embodiments, a pulley component 40 does not comprise a wheel 42, but instead housing 41 has a groove (not shown) to accommodate a cord 200.

Figure 1B:
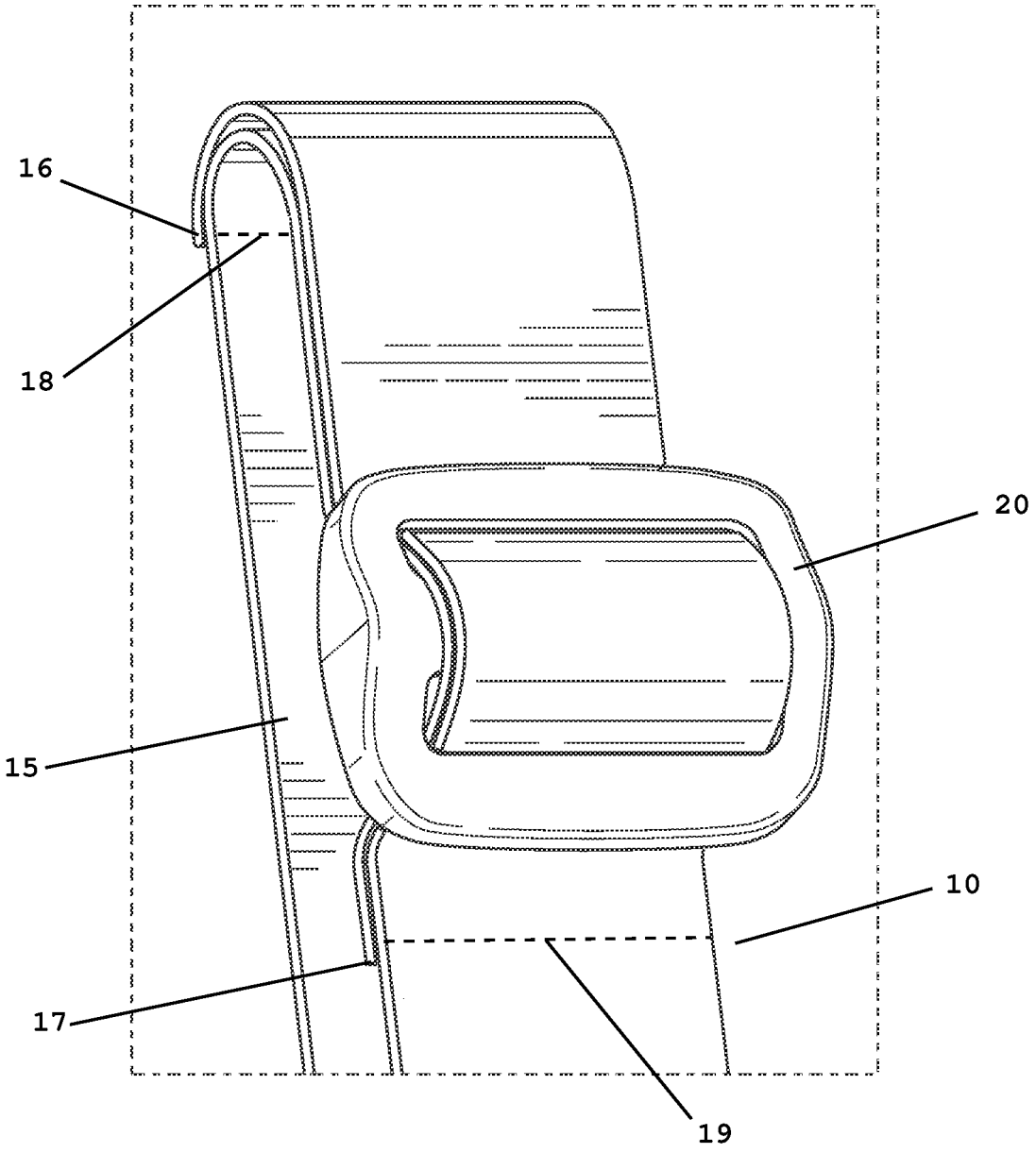
FIG. 1B depicts a partial view of the pulley device of FIG. 1A.
Figure 2A:
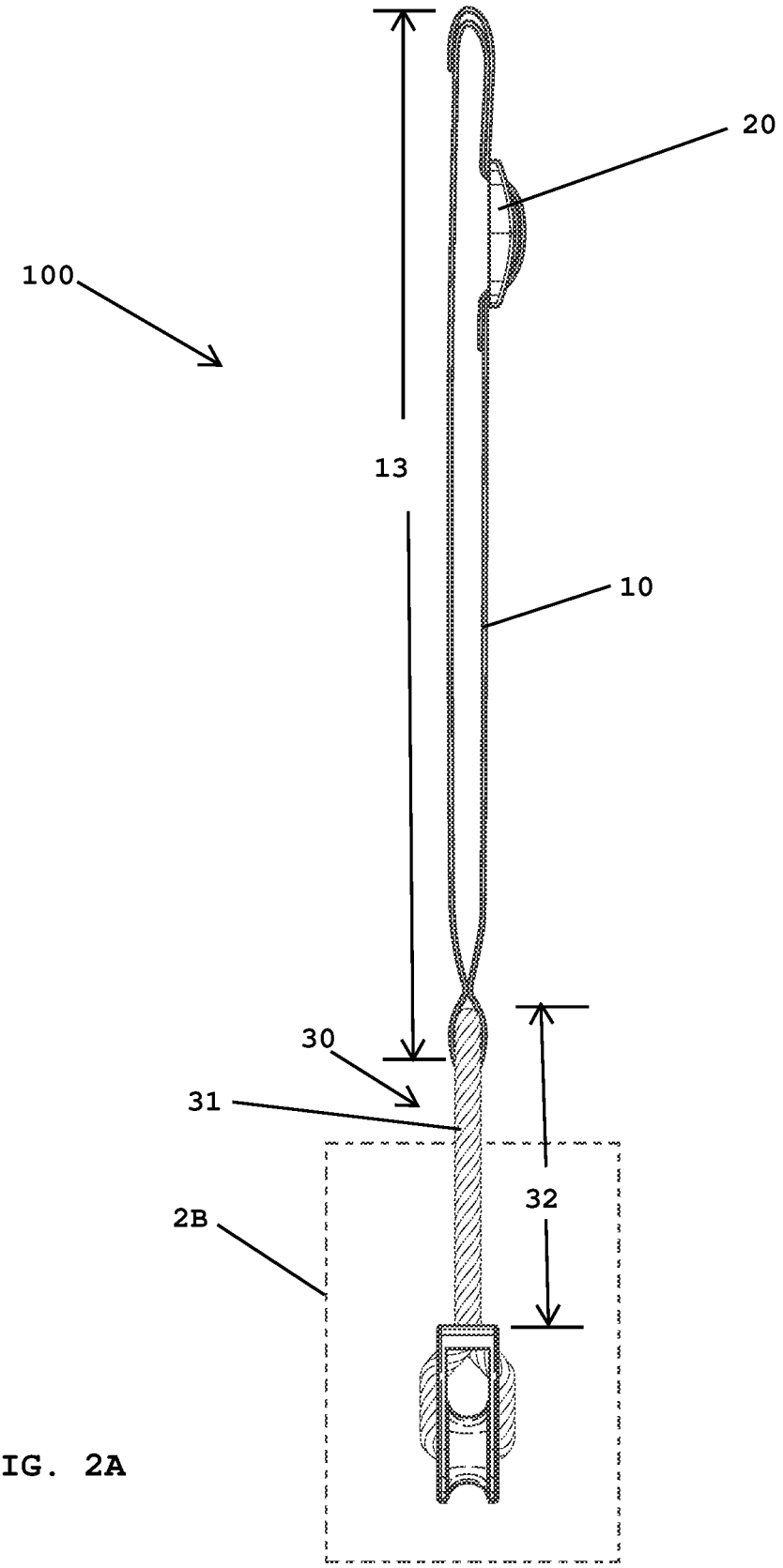
FIG. 2A depicts a side view of the pulley device of FIG. 1A.
Figure 2B:
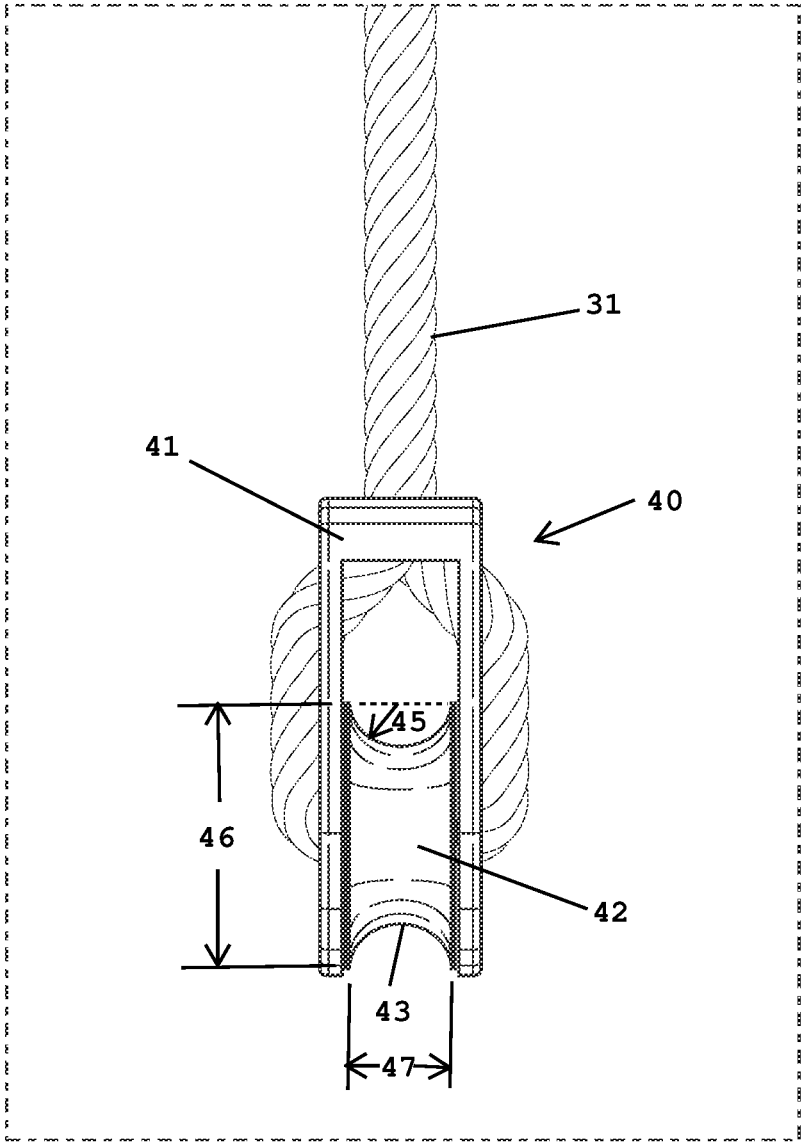
FIG. 2B depicts a partial view of the pulley device of FIG. 1A.

In the embodiment described and depicted herein, strap loop 10 is formed by routing first end 16 and second end 17 of a strap 15 in opposing directions through buckle 20, and then joining the first end 16 and second end 17 to the strap by stitching at locations 18 and 19, respectively, as depicted in FIG. 1B. One skilled in the art will recognize that other means of joining the first and second ends, such as thermal and/or chemical bonding, or combinations thereof, may be used.

The cord 30, as depicted in FIG. 1, may form a loop 31, enabling the loop 31 to be secured over the buckle 20 so that the pulley device 100 may be worn on a person's wrist. In the depicted embodiment, first cord 30 is attached to pulley component 40 by cord loop 31 being routed through a hollow tube formed by axle 44 of wheel 42. One skilled in the art will recognize that, in other embodiments, first cord 30 may be attached to pulley component 40 via other means.

Figure 3:
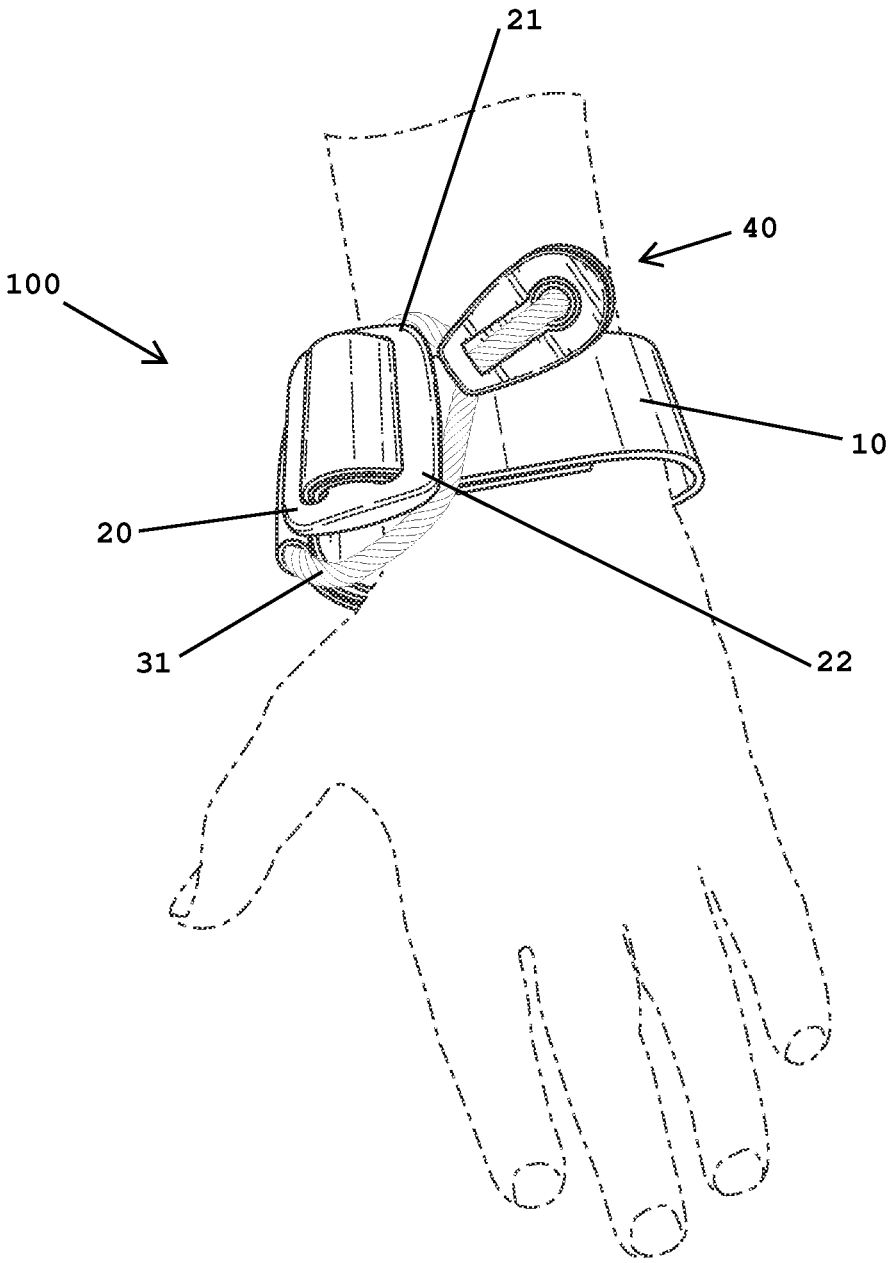
FIG. 3 depicts a pulley device worn on a person's wrist.

In the embodiment described and depicted herein, strap loop 10 may be placed around a person's wrist so that pulley device 100 can be worn on the wrist. Cord loop 31 may be secured over buckle 20 by a person pulling loop 31 to stretch it over and below two corners 21, 22 of the buckle, as shown in FIG. 3. The tension of stretched loop 31 then pulls it against the buckle corners, thus securing the loop over the buckle. In the depicted embodiment, buckle 20 is a slide buckle providing a person with the ability to adjust its position on strap loop 10 to accommodate the particular size of the person's wrist. The position of buckle 20 on strap loop 10 may also be adjusted to be off-center within the loop to accommodate strap loop 10 being placed around an object to be lifted or pulled (see FIGS. 5-6 and descriptions thereof), so that buckle 20 does not contact the object or bear the weight of the object.

Figure 4:
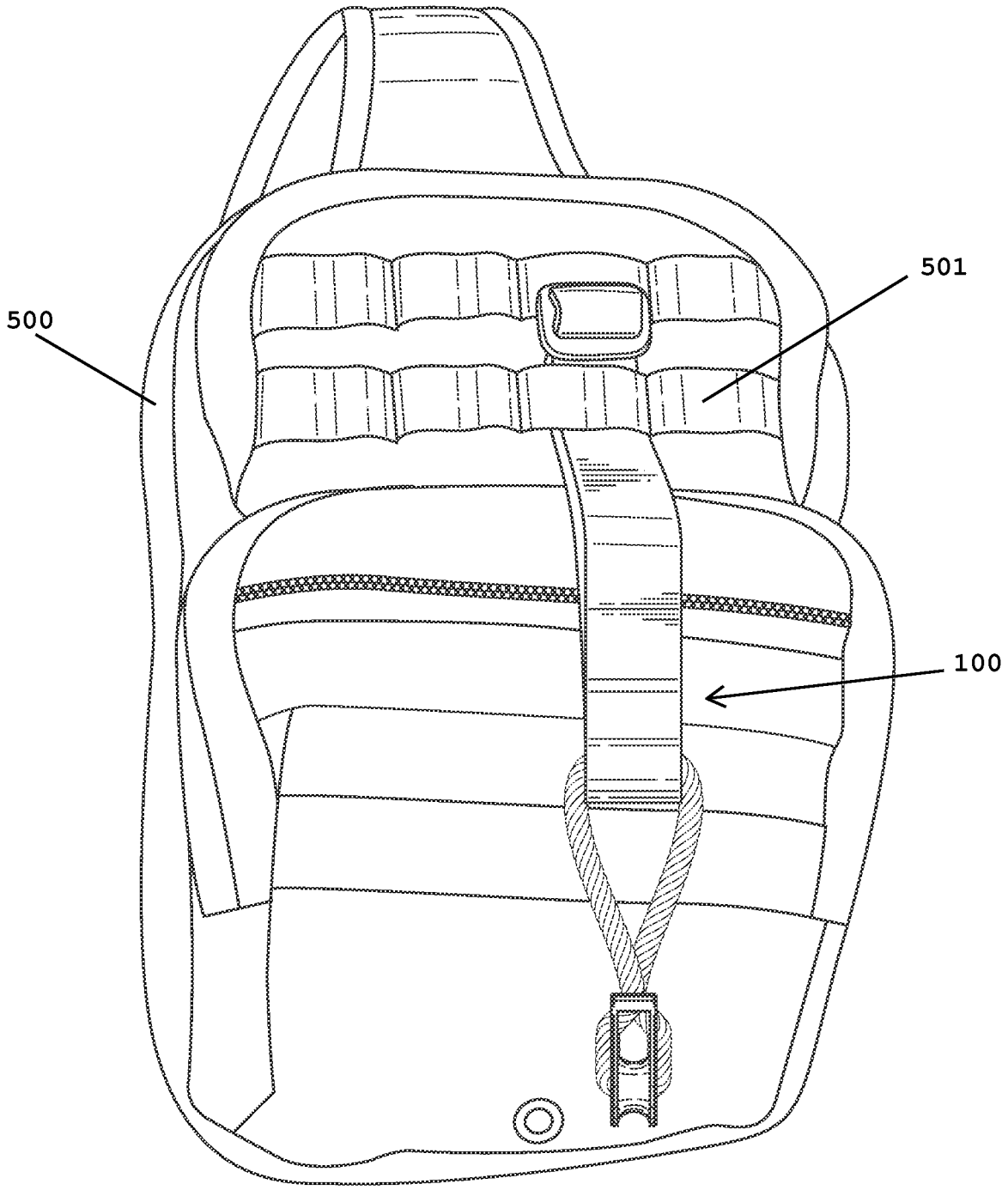
FIG. 4 depicts a pulley device worn on a backpack.

The pulley device 100 may also be attached to a backpack 500, in particular to a grid of webbing 501, such as is provided by a Pouch Attachment Ladder System (PALS), typically found on MOLLE (Modular Lightweight Load-carrying Equipment) backpacks and other equipment, as depicted in FIG. 4.

The ability to wear on one's person (e.g., wrist or backpack) provides access to pulling and lifting equipment that is readily available when needed, since the pulley device is always "at hand", even in an unanticipated situation.

One skilled in the art will recognize that other embodiments of a pulley device may include a cord-securing component other than a buckle, and that the location of such other cord-securing component on a strap loop may be capable of being adjusted.

In some embodiments (not shown), strap loop 10 may be replaced by a strap with unjoined first and second ends, where buckle 20 is attached to the first end and the second end may be routed through buckle 20 in order to form a strap loop. Furthermore, one skilled in the art will recognize that buckle 20 may be replaced by a different type of buckle than the slide buckle that is described and depicted herein. For example, buckle 20 may comprise two components of a snap buckle, or any other type of buckle capable of selectively joining and unjoining the first and second ends of the strap, and may or may not provide for adjusting the size of the strap loop as described above.

Furthermore, in some embodiments, a separate cord-securing component (not shown) is attached to strap loop 10 to provide a means for securing cord loop 31 so that pulley device 100 may be worn on a person's wrist. In such embodiments, cord loop 31 is pulled over (and below if necessary) the cord-securing component as described above with regard to a buckle. A cord-securing component may be any component for which cord loop 31 may be pulled over a portion thereof such that cord loop 31 remains in that position until removed.

The buckle 20, housing 41, and wheel 42 may be made of plastic, metal, or other suitable material or combination of materials. The strap loop 10 may be substantially flat and comprised of a flexible material such as MIL-W-5625K woven nylon tubular webbing, nylon sports webbing, or other durable material or fabric, including a non-tubular material, with strength sufficient to support an object to be pulled or lifted. In some embodiments, the object to be lifted or pulled by a single pulley device may be up to 300 pounds. When multiple pulley devices are combined into a system, the object to be lifted or pulled by a single pulley device may be up to several thousand pounds.

The weight range, material composition, and diameter of a cord 200 to which a pulley device 100 is attached may vary, depending upon the application. For example, a cord 200 may be substantially comprised of MIL-C-5040 Type III braided nylon cord (so-called Paracord 550) or other durable cord with strength sufficient to support an object to be pulled or lifted, including cord with greater or lesser diameter than MIL-C-5040 Type III.

The following dimensions are used in the embodiment of a pulley device 100 that is depicted and described herein. However, other dimensions may be used. The length 13 and width 14 of a strap loop 10 in this embodiment are approximately 7.25 inches and 1 inch, respectively. The length 32 of cord loop 31 is approximately 1.25 inches. The diameter 46 and width 47 of wheel 42, and radius 45 of circumferential groove 43, are approximately ¾, ⅓, and ⅛ inches, respectively.

Figure 5:
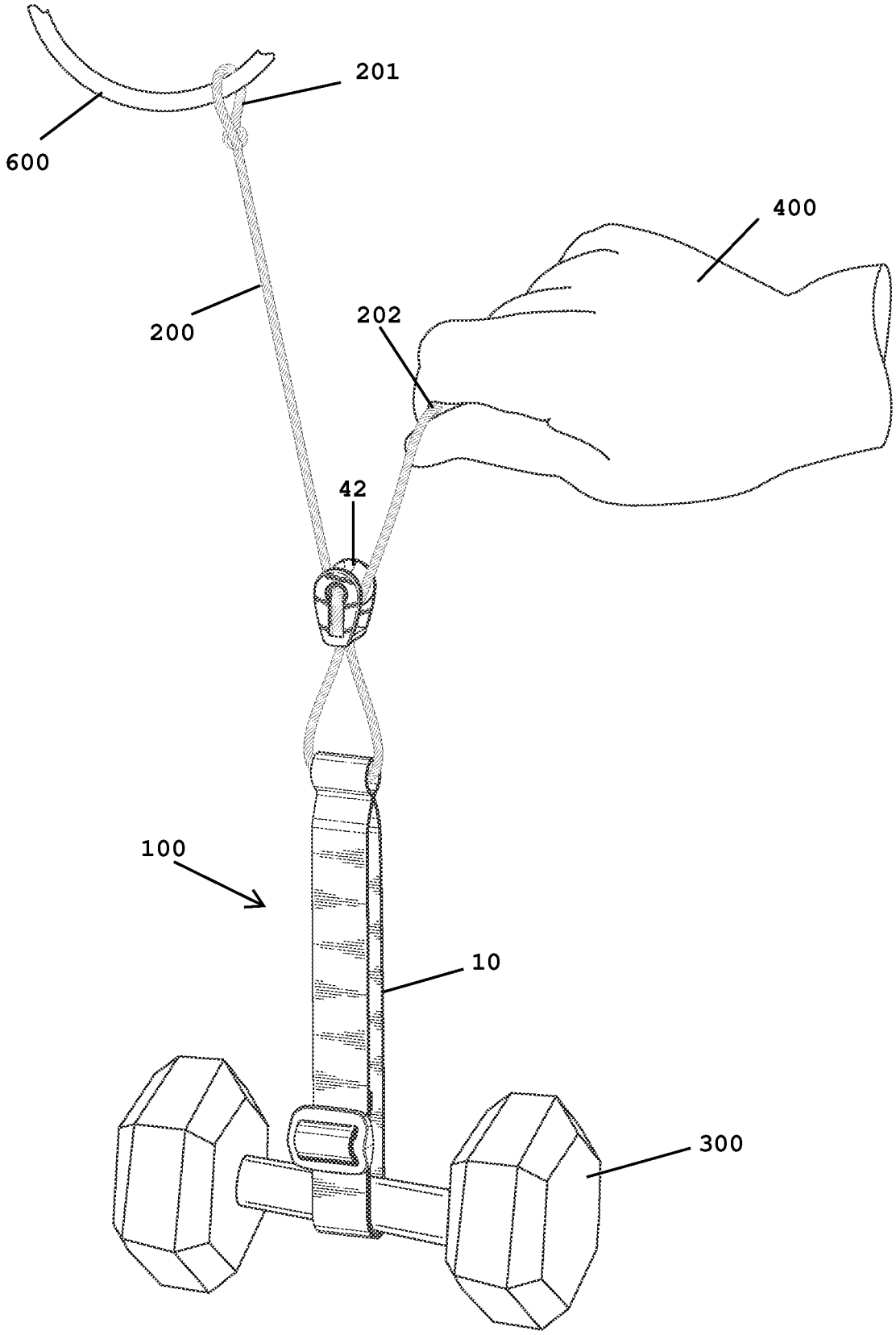
FIG. 5 depicts a first example of a single pulley device in use.

In a first example of using a single pulley device 100, depicted in FIG. 5, a first end 201 of a cord 200 is anchored (e.g., tied) to a fixed object 600 and a second end 202 of cord 200 is routed through wheel 42 of pulley device 100. Pulley device 100 is attached to an object 300 to be lifted by its strap loop 10. Second end 202 of cord 200 may be pulled by a person 400 in order to lift object 300. In this configuration, the use of a single pulley device 100 provides a 2:1 mechanical advantage, e.g., if object 300 weighs 100 pounds, person 400 need only apply a 50-pound force to lift object 300.

Figure 6:
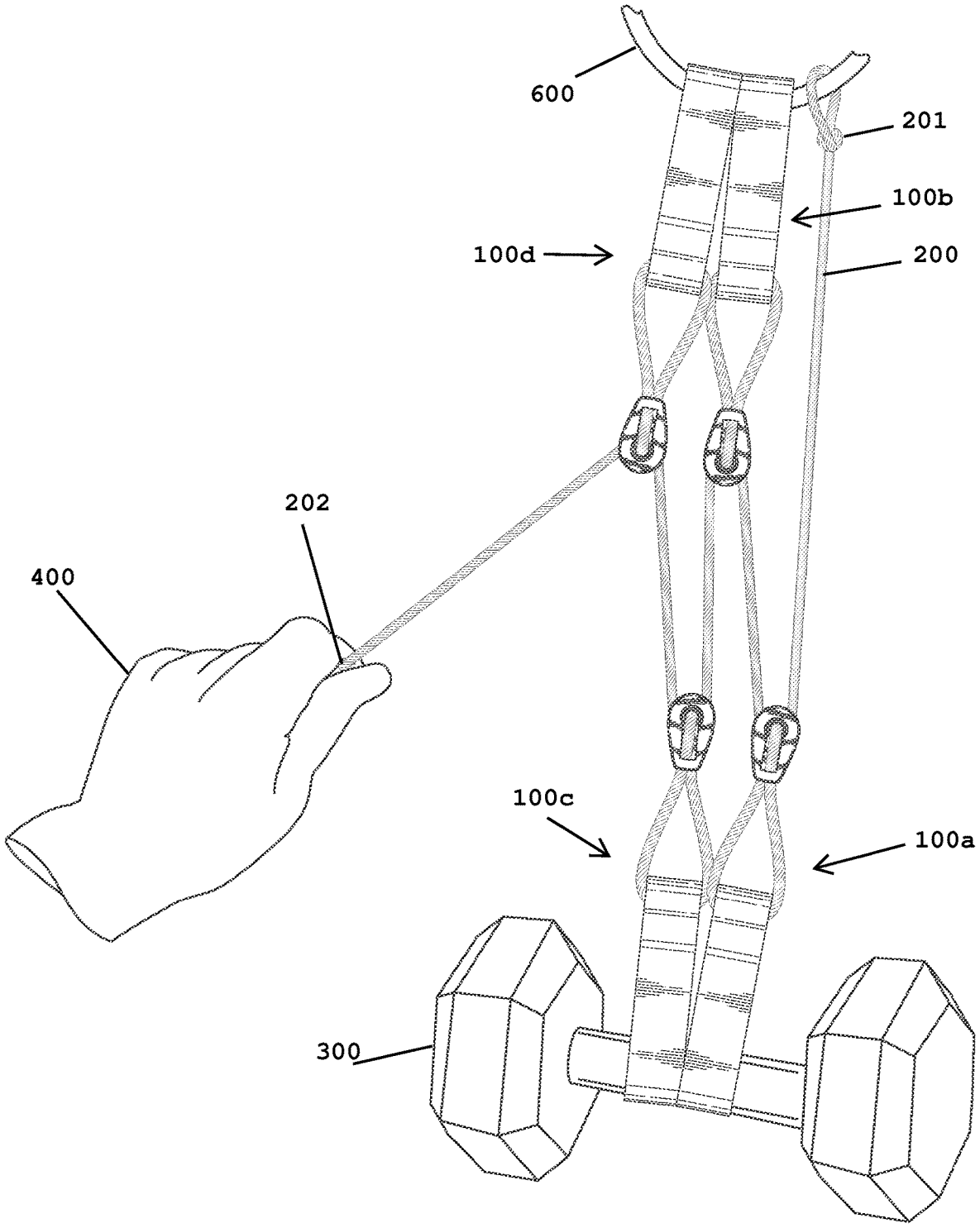
FIG. 6 depicts a set of four pulley devices in use.

In an example of using a set of four pulley devices, depicted in FIG. 6, a first end 201 of a cord 200 is anchored (in this depiction, tied) to fixed object 600 and then is routed through wheels 42 of a first, second, third, and fourth pulley devices 100*a*, 100*b*, 100*c*, and 100*d*, respectively. First and third pulley devices 100*a* and 100*c* are each attached to an object 300 to be pulled or lifted by their respective strap loops 10. Second and fourth pulley devices 100*b* and 100*d* are each anchored to fixed object 600 by their respective strap loops 10. A second end 202 of the cord 200 may be pulled by a person 400. In this configuration, the use of four pulley devices provides a 4:1 mechanical advantage, e.g., if object 300 weighs 100 pounds, person 400 need only apply a 25-pound force to lift object 300.

Figure 7:
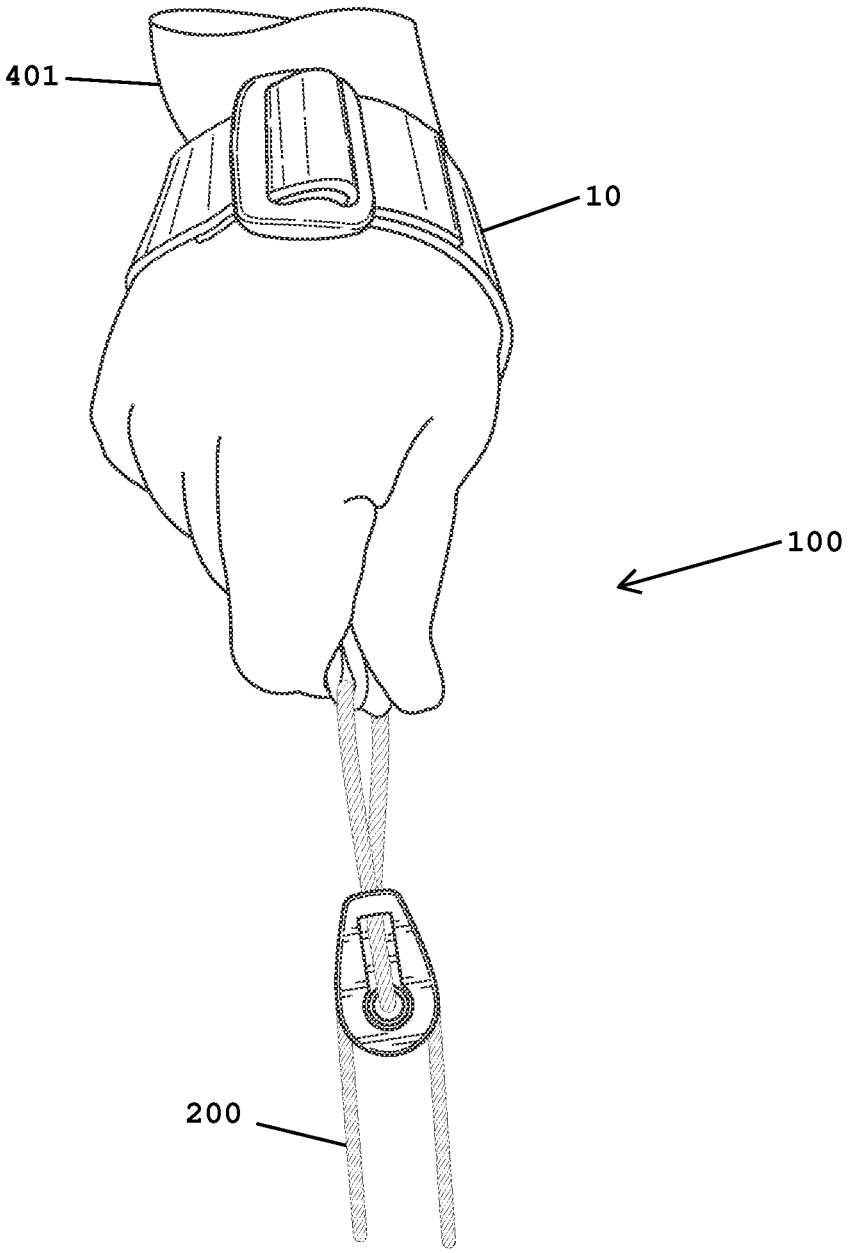
FIG. 7 depicts a second example of a single pulley device in use.

In a second example of using a single pulley device 100, depicted in FIG. 7, strap loop 10 is worn around a first person's wrist 401, and a cord 200 is routed through wheel 42 of pulley device 100. A first end (not shown) of cord 200 is attached to a fixed object (not shown), while a second end (not shown) of cord 200 is held and may be pulled by a second person (not shown) in order to apply force through pulley device 100 in order to pull (e.g., rescue) the first person.

Typical uses of a pulley device 100, or a set of pulley devices 100, include, but are not limited to, lifting a large game animal, extricating or righting a vehicle in an off-road environment, managing trail obstacles, trees, and boulders, lifting or pulling gear such as a backpack, watercraft (e.g., kayak, canoe, jet ski), and a jeep roof, and substituting for a broken winch.

The pulley device 100, as described herein, meets the existing need for non-motorized pulling and lifting equipment that provides a more portable solution and is easy to use, store, carry, and deploy, and that is readily available when needed, in part because it may easily be worn on a person's wrist or attached to backpack, as described and depicted herein.

In addition, the pulley device 100, as described herein, meets the existing need for non-motorized pulling and lifting equipment that provides a more configurable solution, in part because multiple pulley devices may be easily configured to form a more complex pulley system as depicted in FIG. 6 and described herein.

In the descriptions above and in the claims, phrases such as "at least one of" or "one or more of" can occur followed by a conjunctive list of elements or features. The term "and/or" can also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B," "one or more of A and B," and "A and/or B" are each intended to mean "A alone, B alone, or A and B together." A similar interpretation is also intended for lists including three or more items. For example, the phrases "at least one of A, B, and C," "one or more of A, B, and C," and "A, B, and/or C" are each intended to mean "A alone, B alone, C alone, A and B together, A and C together, B and C together, or A and B and C together." In addition, use of the term "based on," above and in the claims, is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations can be within the scope of the following claims.

What is claimed is:

1. A pulley device, said device comprising:

a strap loop comprising a flexible material for placing around a person's wrist, a first cord attached to said strap loop, said first cord comprising a cord loop, a pulley component attached to said first cord, and a cord-securing component attached to said strap loop, said cord-securing component capable of securing said first cord loop, said cord loop capable of being secured on said cord-securing component, enabling said pulley device to be worn on said person's wrist when said strap loop is placed around said person's wrist.

2. The pulley device of claim 1, said first cord substantially comprising a flexible material.

3. The pulley device of claim 1, wherein said cord-securing component is a buckle.

4. The pulley device of claim 1, wherein a position of said cord-securing component on said strap loop is capable of being adjusted.

5. The pulley device of claim 1, wherein said strap loop is substantially flat.

6. The pulley device of claim 1, said pulley component further comprising a housing.

7. The pulley device of claim 6, said pulley component further comprising a wheel arranged to rotate within said housing.

8. The pulley device of claim 7, said wheel comprising a circumferential groove to accommodate a second cord.

9. The pulley device of claim 7, said wheel comprising a substantially flat circumferential side to accommodate a belt.

10. The pulley device of claim 6, said housing comprising a groove to accommodate a second cord.

* * * * *